US010736484B2

(12) United States Patent
Krische et al.

(10) Patent No.: US 10,736,484 B2
(45) Date of Patent: Aug. 11, 2020

(54) DETERGENT DISPENSING DEVICE FOR A DISHWASHER

(71) Applicant: ELECTROLUX APPLIANCES AKTIEBOLAG, Stockholm (SE)

(72) Inventors: Bernd Krische, Stockholm (SE); Stefan Jonsson, Stockholm (SE); Magnus Wahlberg, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 241 days.

(21) Appl. No.: 15/747,529

(22) PCT Filed: Aug. 31, 2015

(86) PCT No.: PCT/EP2015/069856
§ 371 (c)(1),
(2) Date: Jan. 25, 2018

(87) PCT Pub. No.: WO2017/036513
PCT Pub. Date: Mar. 9, 2017

(65) Prior Publication Data

US 2018/0214003 A1 Aug. 2, 2018

(51) Int. Cl.
*A47L 15/44* (2006.01)

(52) U.S. Cl.
CPC ..... *A47L 15/4436* (2013.01); *A47L 15/449* (2013.01); *A47L 15/4409* (2013.01); *A47L 15/4445* (2013.01)

(58) Field of Classification Search
CPC ..... A47L 15/4436; A47L 15/4409; A47L 15/449; A47L 15/4445
See application file for complete search history.

(56) References Cited

U.S. PATENT DOCUMENTS 3,187,767 A * 6/1965 Sherrard ..... A47L 15/4436 137/268
4,020,865 A * 5/1977 Moffat ..... A47L 15/4436 137/268
4,666,682 A * 5/1987 Mayer ..... B01F 1/0033 222/1
4,735,228 A 4/1988 Boedecker et al.
(Continued)

FOREIGN PATENT DOCUMENTS

CN 101778590 A 7/2010
CN 202595511 U 12/2012
CN 104720720 A 6/2015

OTHER PUBLICATIONS

International Search Report and Written Opinion of the International Searching Authority for International Patent Application No. PCT/EP2015/069856 dated Oct. 22, 2015, 8 pages.
(Continued)

*Primary Examiner* — Benjamin L Osterhout
(74) *Attorney, Agent, or Firm* — Alston & Bird LLP

(57) ABSTRACT

A detergent dispensing device for a dishwasher that may include a container for accommodating detergent, at least two inlets to the container, which inlets are arranged such that pressurized fluid entering the inlets are applied onto the detergent from different directions, and an outlet via which the detergent dissolved by the pressurized fluid exits the container.

14 Claims, 7 Drawing Sheets

(56) References Cited

U.S. PATENT DOCUMENTS

| | | | | |
|---|---|---|---|---|
| 5,478,537 | A * | 12/1995 | Laughlin | A47K 5/08 137/268 |
| 5,483,989 | A * | 1/1996 | Lim | A47L 15/44 137/268 |
| 8,721,804 | B2 | 5/2014 | Beshears, Jr. et al. | |
| 2006/0249183 | A1* | 11/2006 | Kon | A47L 15/4436 134/93 |
| 2011/0197934 | A1 | 8/2011 | Fueglein et al. | |
| 2012/0138100 | A1* | 6/2012 | Beshears, Jr. | A47L 15/4221 134/25.2 |

OTHER PUBLICATIONS

Search Report and Written Opinion for Brazilian Application No. BR112018002490-2 dated Apr. 1, 2020, 4 pages.
Office Action for Chinese Application No. 201580082293.5 dated Apr. 1, 2020, 11 pages.

* cited by examiner

DETERGENT DISPENSING DEVICE FOR A DISHWASHER

CROSS-REFERENCE TO RELATED APPLICATIONS

This application is a national stage application filed under 35 U.S.C. § 371 of International Application No. PCT/EP2015/069856 filed Aug. 31, 2015, which application is hereby incorporated by reference in its entirety.

TECHNICAL FIELD

The invention relates to a detergent dispensing device for a dishwasher, and a method of dispensing detergent in a dishwasher.

BACKGROUND

In the art, dishwashers are arranged, on an inside of a door closing the dishwasher tub, with a small detergent dispenser having a lid being controllably opened to dispense detergent from the dispenser into the tub.

This arrangement has a number of disadvantages. Firstly, a control system of the dishwasher must be configured to control the opening and closing of the lid in order to appropriately dispense detergent into the dishwasher, generally requiring a microprocessor controlling a solenoid to open and close the lid.

Secondly, dispensing of detergent into the dishwasher becomes inexact with this arrangement in terms of location in the tub where the detergent is released.

Thirdly, the detergent dissolves slowly with this arrangement. There are three major types of detergent; powder, liquid and tablets, and the dissolution of the detergent is particularly slow in the case of detergent compacted into tablet form. Occasionally, the tablet adheres to the dispenser during operation of a washing program and consequently does not even fall into the dishwasher compartment for dissolving.

U.S. Pat. No. 8,721,804 discloses a dishwasher including an auxiliary dispenser assembly used in conjunction with an auxiliary spray unit having a plurality of spray heads arranged along a wall of a washing chamber to create an intensified wash zone in the washing chamber. The dispenser assembly includes a storage compartment for housing a washing agent, a plurality of inlets leading to the storage compartment from one side and an outlet leading from the storage compartment. During at least one stage of a washing operation, at least a portion of the washing fluid delivered to the auxiliary spray unit is diverted and forced to flow through the storage compartment in order to pick-up additional detergent which is then delivered into the washing chamber for enhanced cleansing purposes.

A problem with the assembly of U.S. Pat. No. 8,721,804 is that the dissolving of detergent still is rather slow, although improved as compared to a single inlet solution.

SUMMARY

An object of the present is to solve, or at least mitigate, this problem in the art and to provide an improved detergent dispensing device for dissolving detergent in a dishwasher.

This object is attained in a first aspect of the invention by a detergent dispensing device for a dishwasher, comprising a container for accommodating detergent, at least two inlets to the container, which inlets are arranged such that pressurized fluid entering the inlets are applied onto the detergent from different directions, and an outlet via which the detergent dissolved by the pressurized fluid exits the container.

This object is attained in a second aspect of the invention by a method of dispensing detergent in a dishwasher. The method comprises applying pressurized fluid onto the detergent accommodated in a container from different directions, and dispensing the detergent dissolved by the pressurized fluid into a washing compartment of the dishwasher.

Advantageously, by providing the container accommodating the detergent with a plurality of inlets via which pressurized fluid is applied onto the detergent from different directions, a rate with which the detergent is dissolved greatly increases. Hence, by arranging the container with at least two inlets arranged such that the fluid is applied onto the detergent from different directions, the detergent will dissolve at a much higher rate as compared to applying the fluid from the same direction. This is particularly important when performing a quick wash, where it is desirable that the detergent dissolves more or less instantly due to the short washing programme operating time.

A further major advantage of the invention is that the prior art dispenser which traditionally is arranged on an inside of a door of the dishwasher for closing and sealing the dishwasher compartment can be omitted. Instead, the detergent dispensing device of the invention is arranged at a location in the compartment of the dishwasher where it is easily accessible to a user. In an embodiment, the detergent dispensing device is arranged at an upper rack of the dishwasher.

Advantageously, in an embodiment, by providing the container accommodating the detergent with a plurality of inlets via which pressurized fluid is applied onto the detergent from opposite directions, a rate with which the detergent is dissolved increases even further. Hence, by arranging the container with at least two inlets arranged on opposing sides of the container, the pressurized fluid applied onto the detergent via the inlets will dissolve at an even higher rate as compared to applying the fluid from the same direction, in which case the tablet may be pressed against the opposite wall of the container accommodating the tablet, thus preventing a surface of the tablet facing the opposite wall from adequate dissolution.

A further advantage is that, if the container is arranged with an open top section via which the detergent is accommodated in the container, as is the case in an embodiment of the invention, the opposing jets of fluid applied to the detergent from the inlets will retain the detergent (in particular in the case of a tablet) in the centre of the container which results in the jets dissolving the tablet on multiple sides, thereby increasing dissolution speed while keeping it from falling out of the container. An advantage of having an open top section is that user easily can place the detergent in the container without operating a container opening mechanism.

In a further embodiment of the invention, the open section of the container will serve as an outlet via which the dissolved detergent exits the container.

This is advantageous since the dissolved detergent easily can leave the container and flow into the dishwasher compartment. As compared to the art, where dissolved detergent leaves via an outlet in the form of a flow tube and possibly even a spray head or nozzle, the open top outlet is further advantageous since larger pieces of detergent that may come off from a tablet during the application of pressurized fluid will not block the outlet.

In still a further embodiment, the detergent dispensing device comprises a cover arranged to close the container. Advantageously, by having a cover, e.g. a lid, on the container, it is possible to protect the detergent from process water and thereby prevent the detergent in the container from being dissolved upon placing the detergent in the container and closing the cover. For instance, during a prewash or rinse programme, it may be desirable to not dissolve the detergent. During such a programme, no pressurized fluid is supplied to the detergent dispensing device via the inlets. This is in embodiment supervised by a controller, such as a microprocessor, configured to control the amount of fluid supplied to the detergent dispensing device, for instance by controlling a valve regulating the supplied flow of fluid. To avoid having the process water circulating in the compartment during the prewash/rinse programme dissolve the detergent, the user may advantageously close the container with the cover.

In yet an embodiment, in case a cover is used, the cover is advantageously pivotally attached to the container, for instance by means of a hinge mechanism. Thus, when a normal washing programme commences upon completion of the prewash programme, and the pressurized fluid is applied to the detergent, dissolved detergent pressing against the cover from inside of the container will causes the cover to at least partially open such that the dissolved detergent can enter the washing compartment.

In a further embodiment, the fluid supplied to the detergent dispensing device for dissolving the detergent is provided via a conduit attached to the container configured to transport the pressurized fluid from a fluid circulation system of the dishwasher to the at least two container inlets.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
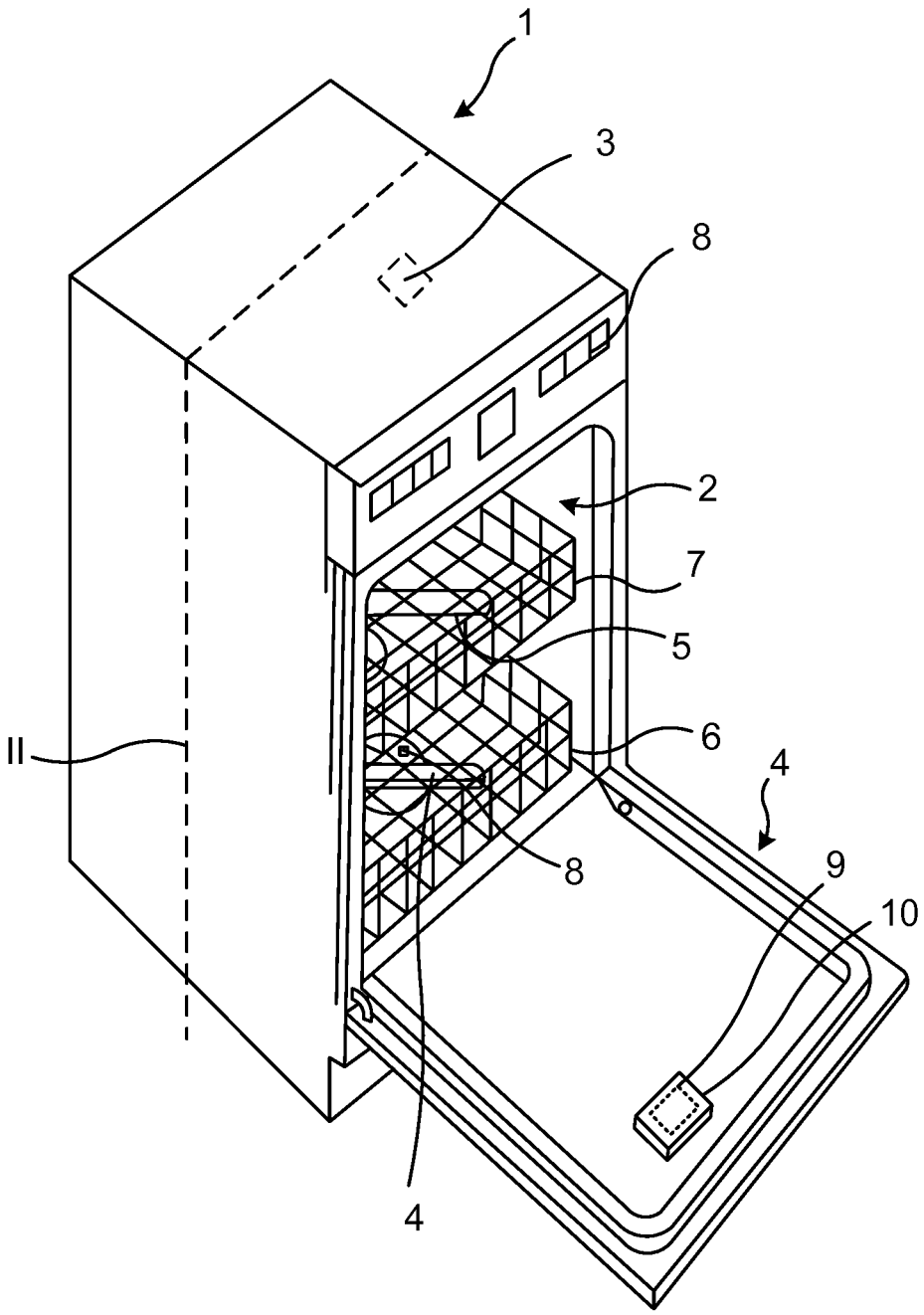
FIG. 1 shows a prior art dishwasher in which the present invention can be implemented.

FIG. 1 shows a prior art dishwasher 1 in which the present invention can be implemented. It should be noted that dishwashers can take on many forms and include many different functionalities. The dishwasher 1 illustrated in FIG. 1 is thus used to explain different embodiments of the present invention and should only be seen as an example of a dishwasher in which the present application can be applied.

The exemplifying dishwasher 1 comprises a washing compartment or tub 2, a door 4 configured to close and seal the washing compartment 2, a spraying system having a lower spray arm 4 and an upper spray arm 5, a lower rack 6 and an upper rack 7. Additionally, it may comprise a specific top rack for cutlery (not shown). A controller 3 such as a microprocessor is arranged in the interior of the dishwasher for controlling washing programmes and is communicatively connected to an interface 8 via which a user can select washing programmes.

The door 4 of the prior art dishwasher 1 illustrated in FIG. 1 is further on its inside arranged with a small detergent dispenser 9 having a lid 10 being controllably opened and closed by the controller 3, typically in cooperation with a solenoid (not shown), for dispensing detergent from the dispenser 9 into the tub 2.

Figure 2:
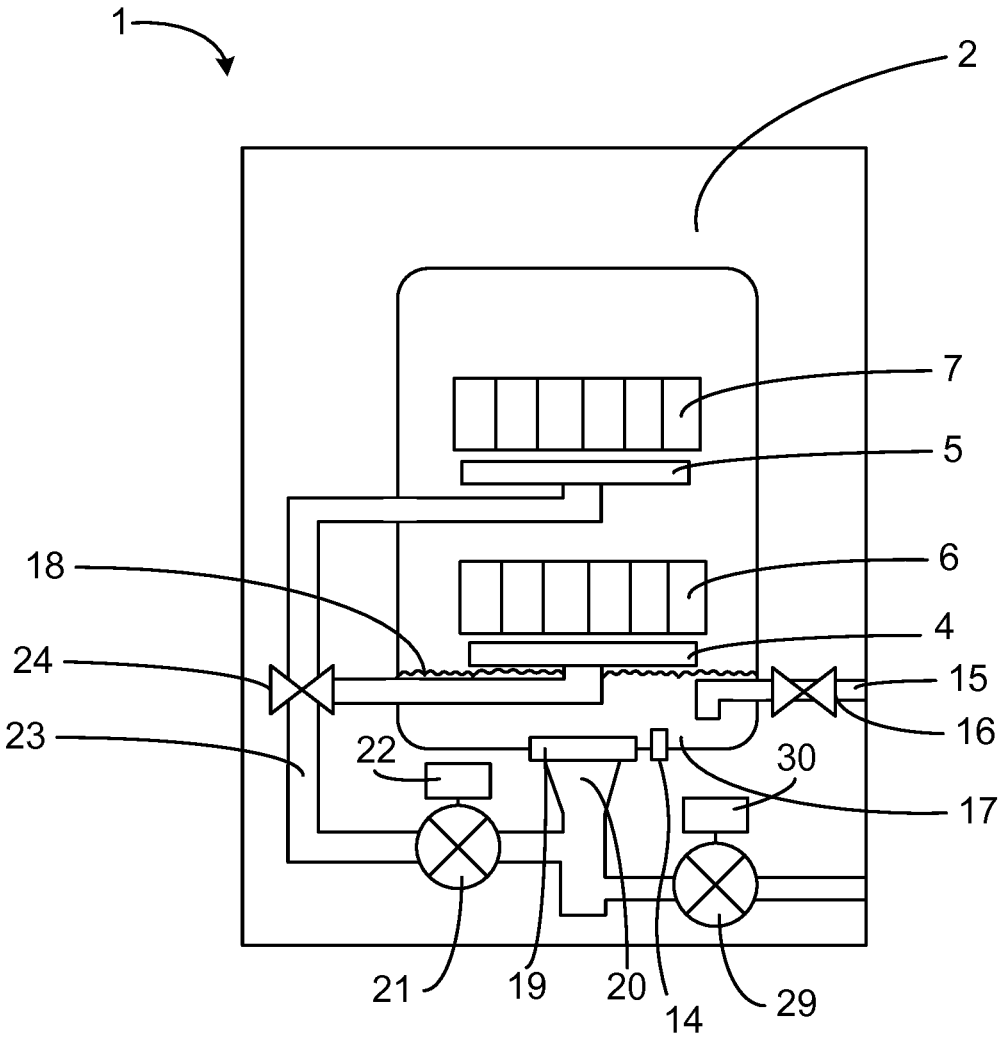
FIG. 2 schematically illustrates a cross-sectional view of the dishwasher of FIG. 1 taken along section II.

FIG. 2 schematically illustrates a cross-sectional view of the dishwasher 1 of FIG. 1 taken along section II, to further illustrate components included in a dishwasher 1. Hence, as previously mentioned, the dishwasher 1 comprises a washing compartment or tub 2 housing an upper basket 7 and a lower basket 6 for accommodating goods to be washed such as cutlery, plates, drinking-glasses, trays, etc.

Detergent in the form of liquid, powder or tablets is dosed in a detergent compartment located on the inside of a door (not shown in FIG. 2) of the dishwasher 1 by a user, which detergent is controllably discharged into the washing compartment 2 in accordance with a selected washing programme. As previously mentioned, the operation of the dishwasher 1 is typically controlled by the controller 3 (not shown in FIG. 2) executing appropriate software.

Fresh water is supplied to the washing compartment 2 via water inlet 15 and water supply valve 16. This fresh water is eventually collected in a so called sump 17, where the fresh water is mixed with the discharged detergent resulting in process water 18.

By the expression "process water" as used herein, is meant a liquid containing mainly water that is used in and circulates in a dishwasher. The process water is water that may contain detergent and/or rinse aid in a varying amount. The process water may also contain soil, such as food debris or other types of solid particles, as well as dissolved liquids or compounds. Process water used in a main wash cycle is sometimes referred to as the wash liquid. Process water used in a rinse cycle is sometimes referred to as cold rinse or hot rinse depending on the temperature in the rinse cycle. The pressurized fluid supplied to the detergent dispensing device according to embodiments of the invention thus at least partly contains process water.

At the bottom of the washing compartment is a filter 19 for filtering soil from the process water before the process water leaves the compartment via process water outlet 20 for subsequent re-entry into the washing compartment 2 through circulation pump 21. Thus, the process water 18 passes the filter 19 and is pumped through the circulation pump 21, which typically is driven by a brushless direct current (BLDC) motor 22, via a duct 23 and process water valve 24 and sprayed into the washing compartment 2 via nozzles (not shown) of a respective wash arm 4, 5 associated with each basket 6, 7. Thus, the process water 18 exits the washing compartment 2 via the filter 19 and is recirculated via the circulation pump 21 and sprayed onto the goods to be washed accommodated in the respective basket via nozzles of the wash arms 4, 5. Further, a controllable heater 14 is typically arranged in the sump 17 for heating the process water 18.

The washing compartment 2 of the dishwasher 1 is drained on process water 18 with a drain pump 29 driven by a BLDC motor 30. It should be noted that it can be envisaged that the drain pump 29 and the circulation pump 21 may be driven by one and the same motor.

Figure 3:
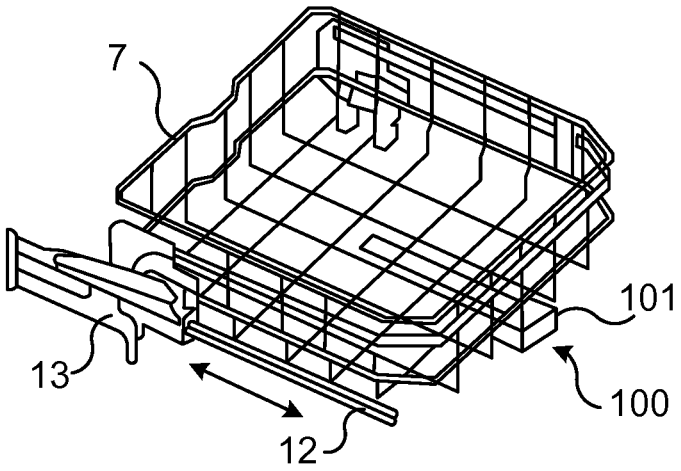
FIG. 3 exemplifies implementation of a detergent dispensing device according to an embodiment of the invention in a dishwasher.

FIG. 3 exemplifies an implementation of a detergent dispensing device 100 according to an embodiment of the invention in a dishwasher. FIG. 3 illustrates the upper rack 7 having been pulled out from the washing compartment by means of a sliding rail 12 movably fastened to a holder 13 in the interior of the washing compartment. It can be envisaged that the detergent dispensing device 100 of the invention is releasably attached to the upper rack 7 such that it can be detached for cleaning.

In this particular embodiment, the detergent dispensing device 100 is attached to a front section of the upper rack 7 thereby advantageously making the detergent dispensing device 100 easily accessible. Thus, a user places detergent in the container 101 of the device 100, closes the door to the dishwasher and selects a washing programme. The washing programme will subsequently start, and the detergent in the container 101 will be dissolved in the compartment. With reference again to the prior art dishwasher 1 of FIG. 1, a major advantage of the invention is that the dispenser 9 arranged on the inside of the door 4 for closing the compartment 2 of the dishwasher 1 for closing and sealing the dishwasher compartment can be omitted. Instead, the detergent dispensing device of the invention is arranged at a location in the compartment of the dishwasher where it is easily accessible to a user. It should be noted that the detergent dispensing device 100 is shown to be attached to the upper rack 7, but may be located at any appropriate location other than at the upper rack, such as at a top cutlery rack (not shown in FIG. 1). It should be noted that the prior art dispenser 9 arranged on the inside of the door 4 may comprise a rinse aid compartment, which may need to be integrated e.g. with a softener container (not shown) generally available in the sump 17 of the compartment 2 in case the dispenser 9 is no longer needed.

Figure 4A:
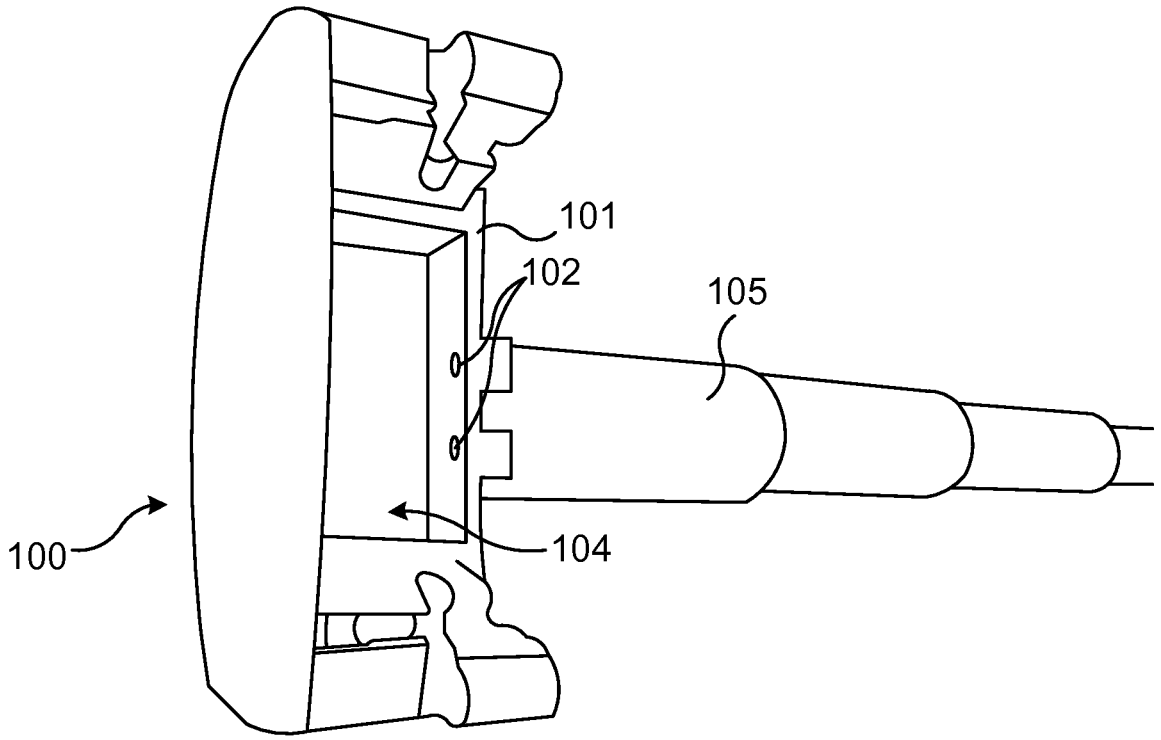
FIGS. 4*a* and *b* illustrate the detergent dispensing device according to an embodiment of the invention in two different perspective views.
Figure 4B:
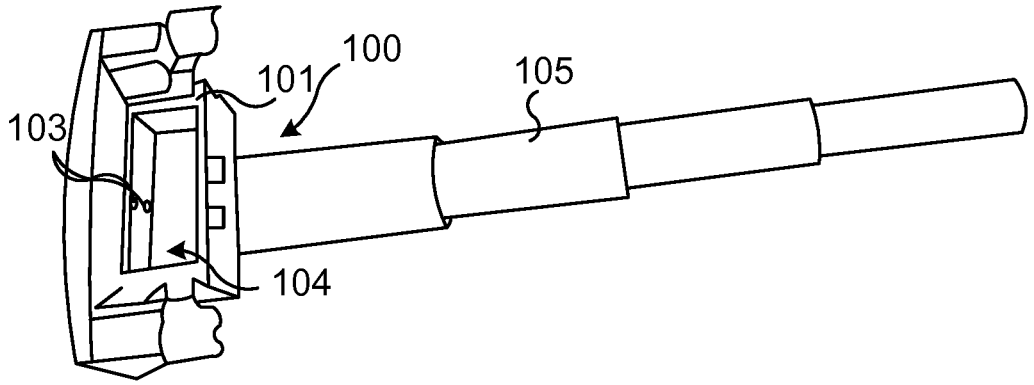
FIG. 4*c* shows a flowchart illustrating a method of dispensing detergent in a dishwasher according to an embodiment of the invention.
Figure 4C:
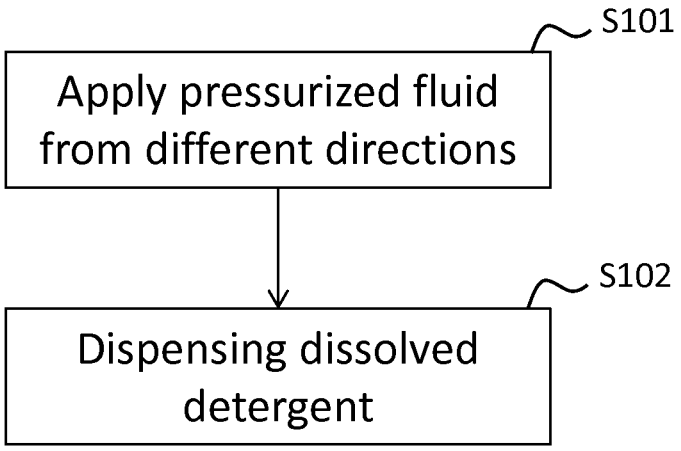

FIGS. 4*a* and *b* show the detergent dispensing device 100 according to an embodiment of the invention in more detailed views. Reference is further made to FIG. 4*c* for illustrating a method of dispensing detergent according to an embodiment of the invention. As can be seen in FIGS. 4*a* and *b*, the container 101 of the detergent dispensing device 100 comprises two inlets 102 on a side of the container facing a back section of the dishwasher compartment, and two inlets 103 on a side of the container facing a front section of the compartment. The size of the inlets is typically 3 mm in diameter.

An open top section 104 of the container will in this particular embodiment serve as an outlet for the dissolved detergent. Further shown is a conduit 105 attached to the container 101 configured to transport the pressurized fluid from a fluid circulation system of the dishwasher to the at least two opposing container inlets 102, 103. For instance, with reference to FIG. 2, the conduit 105 for transporting pressurized fluid may be connected to the circulation pump 21 via the duct 23 and the process water valve 24. Any appropriate number of opposing inlets can be envisaged.

Typically, the flow rate of the fluid entering the container 101 via the inlets 102, 103 is at least 3 l/min for the detergent to be dissolved at an appropriately high rate.

Thus, detergent placed in the container 100 of the detergent dispensing device 100 will advantageously be subjected in step S101 to pressurized jets of fluid from two opposing directions via inlets 102 and 103, respectively, the fluid entering the inlets via the conduit 105. When dissolving, the detergent will in step s102 spill over into the compartment of the dishwasher via the outlet in the form of the open top section 104 of the container 101. Further advantageous is that the opposing jets of fluid applied to the detergent from the inlets 102, 103 will retain the detergent (in particular in the case of a tablet) in the container 101 and keep it from falling out of the container before having been dissolved.

It may be envisaged that the dissolved detergent exits the container 101 via an outlet in the form of a pipe (not shown) instead of an overflow via the open top outlet 104. However, an advantage of the open top outlet 104 is that the dissolved detergent easily can leave the container and flow into the dishwasher compartment. The open top outlet 104 is further advantageous in that larger pieces of detergent that may come off from a tablet during the application of pressurized fluid will not cause blockage of the detergent dispensing device 100.

Figure 5:
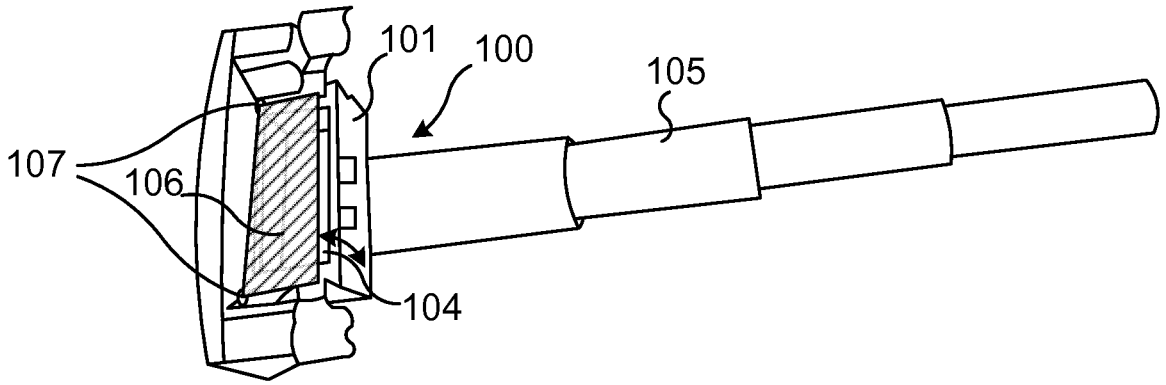
FIG. 5 illustrates the detergent dispensing device according to another embodiment of the invention.

With reference to FIG. 5, in still a further embodiment, the detergent dispensing device 100 comprises a cover 106 arranged to close the container. Advantageously, by having the cover 106 on the open top section 104 of the container 101, it is possible to protect the detergent from process water circulating in the dishwasher compartment and thereby prevent the detergent in the container 101 from being dissolved upon placing the detergent in the container 101 and closing the cover 106. For instance, during a prewash or rinse programme, it may be desirable to not dissolve the detergent. During such a programme, no pressurized fluid is supplied to the detergent dispensing device 100 via the opposing inlets 102, 103.

With reference to FIG. 1, this is in an embodiment supervised by the controller 3 configured to control the amount of fluid supplied to the detergent dispensing device 100, for instance by controlling a valve (for instance the process water valve 24 illustrated in FIG. 2) regulating the supplied flow of fluid. In order to advantageously avoid having the process water circulating in the compartment during the prewash/rinse programme dissolve the detergent, the user may hence close the container 101 with the cover 106.

Again with reference to FIG. 5, in an embodiment, the cover 106 is advantageously pivotally attached to the container 101, for instance by means of a hinge mechanism 107 around which the cover may pivot. Thus, when a normal washing programme commences upon completion of the prewash programme, and the pressurized fluid is applied to the detergent via the inlets 102, 103, dissolved detergent pressing against the cover 106 from inside of the container 101 will cause the cover 101 to pivot around the hinge mechanism 107 and at least partially open such that the dissolved detergent can enter the washing compartment.

Figure 6A:
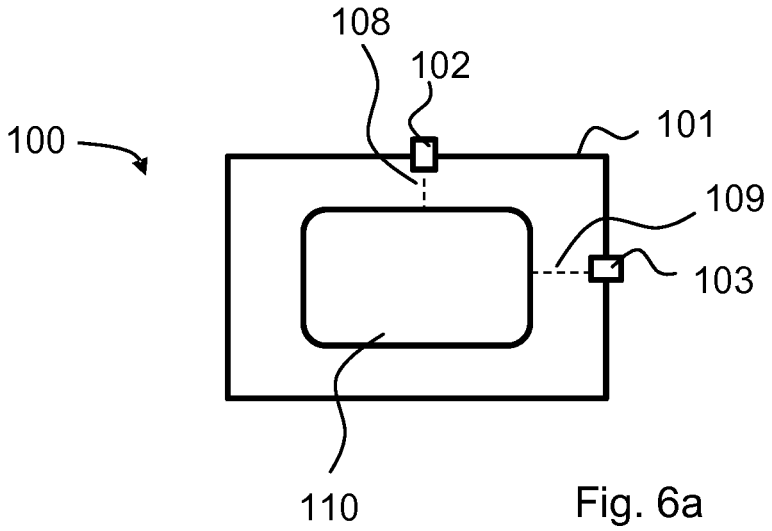
FIGS. 6*a-c* illustrate the detergent dispensing device according to various embodiments of the invention.

FIG. 6*a* illustrates a top view of the detergent dispensing device 100 according to an embodiment of the invention, where inlets 102, 103 to the container 101 apply pressurized fluid 108, 109 onto the detergent 110 from different directions. In the embodiment of FIG. 6*a*, the inlets 102, 10 are arranged such that a first jet 108 of pressurized fluid is applied to the detergent 110 from a direction perpendicular from that of a second jet 109.

Figure 6B:
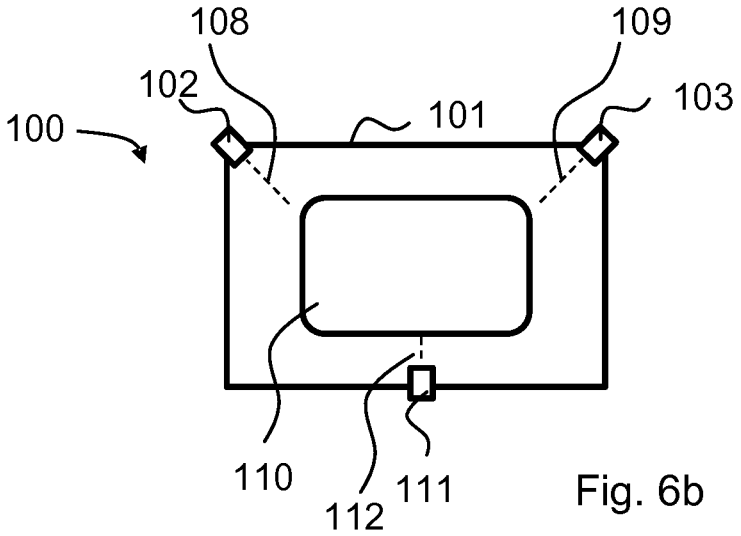

FIG. 6*b* shows another envisaged detergent dispensing device 100, where three inlets 102, 103, 111 to the container 101 apply pressurized fluid 108, 109, 112 onto the detergent 110 from different directions.

Figure 6C:
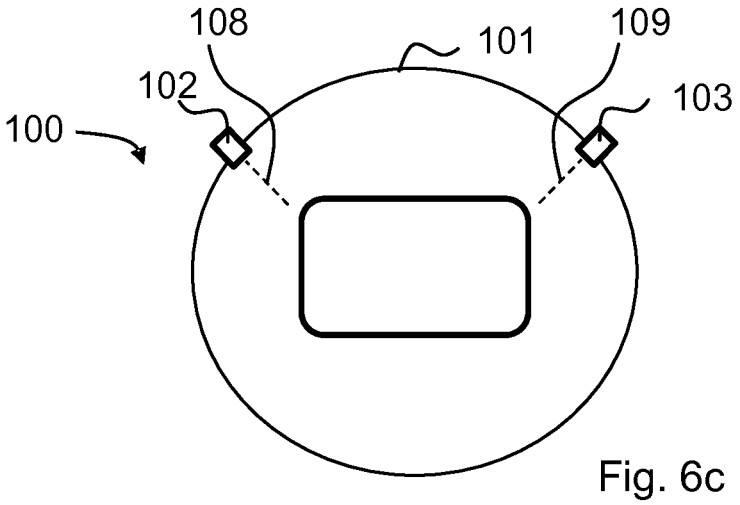

FIG. 6*c* shows yet another envisaged detergent dispensing device 100, where inlets 102, 103 to a circular-shaped container 101 apply pressurized fluid 108, 109 onto the detergent 110 from different directions.

As can be deducted from FIGS. 6*a-c*, various different configurations regarding directions of the pressurized fluid, number of inlets, shape of container, etc., may be envisaged.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A detergent dispensing device for a dishwasher, comprising:

a container for accommodating detergent;

at least two inlets to the container, which inlets are oriented in different directions and are arranged such that pressurized fluid entering the inlets are applied onto the detergent from different directions; and an outlet via which the detergent dissolved by the pressurized fluid exits the container and enters a washing compartment of the dishwasher.

2. The detergent dispensing device of claim 1, wherein:

the at least two inlets are arranged such that pressurized fluid entering the inlets are applied onto the detergent from opposite directions.

3. The detergent dispensing device of claim 1, further comprising:

a conduit attached to the container configured to transport the pressurized fluid from a fluid circulation system of the dishwasher to the at least two container inlets.

4. The detergent dispensing device of claim 1, the container being arranged with an open top section via which the detergent is accommodated in the container.

5. The detergent dispensing device of claim 3, further comprising:

a cover arranged to close the container.

6. The detergent dispensing device of claim 4, the cover being pivotally attached to the container, wherein the cover is configured to be at least partially opened by dissolved detergent pressing against the cover from inside of the container.

7. The detergent dispensing device of claim 4, the open top section further forming the outlet via which the dissolved detergent exits the container.

8. The detergent dispensing device of claim 1, further being arranged to be attached to an upper rack of the dishwasher.

9. The detergent dispensing device of claim 1, the container comprising:

groups of inlets, each group being arranged on opposing sides of the container.

10. A dishwasher comprising the detergent dispensing device of claim 1.

11. The dishwasher of claim 10, further comprising:

a controller to control supply of pressurized fluid to the detergent dispensing device.

12. The dishwasher of claim 11, the controller further being configured to control flow rate of the pressurized fluid entering the container via the inlets to be at least 21/min.

13. A method of dispensing detergent in a dishwasher, comprising:

applying pressurized fluid onto the detergent accommodated in a container from different directions using at least two inlets oriented in different directions;

dispensing the detergent dissolved by the pressurized fluid into the washing compartment of the dishwasher.

14. The method of claim 13, wherein the pressurized fluid applied onto the detergent accommodated in the container is applied from opposite directions.

* * * * *